US008757958B2

(12) United States Patent
Lussier

(10) Patent No.: US 8,757,958 B2
(45) Date of Patent: Jun. 24, 2014

(54) COMPOSITE FAN CONTAINMENT CASE

(75) Inventor: Darin S. Lussier, Berlin, CT (US)

(73) Assignee: United Technologies Corporation, Hartford, CT (US)

( * ) Notice: Subject to any disclaimer, the term of this patent is extended or adjusted under 35 U.S.C. 154(b) by 1449 days.

(21) Appl. No.: 12/551,018

(22) Filed: Aug. 31, 2009

(65) Prior Publication Data

US 2011/0052383 A1 Mar. 3, 2011

(51) Int. Cl.
*F01D 25/28* (2006.01)

(52) U.S. Cl.
USPC ..... 415/9; 415/197

(58) Field of Classification Search
USPC ..... 415/9, 173.4, 174.4, 196, 197, 200
See application file for complete search history.

(56) References Cited

U.S. PATENT DOCUMENTS

| | | | | |
|---|---|---|---|---|
| 4,902,201 | A * | 2/1990 | Neubert | 415/197 |
| 5,344,280 | A * | 9/1994 | Langenbrunner et al. | 415/9 |
| 5,885,056 | A * | 3/1999 | Goodwin | 415/9 |
| 6,059,524 | A | 5/2000 | Costa et al. | |
| 6,149,380 | A | 11/2000 | Kuzniar et al. | |
| 6,187,411 | B1 * | 2/2001 | Palmer | 428/102 |
| 6,217,277 | B1 | 4/2001 | Liu et al. | |
| 6,619,913 | B2 * | 9/2003 | Czachor et al. | 415/119 |
| 6,638,008 | B2 | 10/2003 | Sathianathan et al. | |
| 6,652,222 | B1 | 11/2003 | Wojtyczka et al. | |
| 6,814,541 | B2 | 11/2004 | Evans et al. | |
| 6,913,436 | B2 * | 7/2005 | McMillan et al. | 415/9 |
| 7,076,942 | B2 | 7/2006 | Schreiber | |
| 7,266,941 | B2 | 9/2007 | Eleftheriou et al. | |
| 7,517,184 | B2 | 4/2009 | Costa et al. | |
| 7,713,021 | B2 * | 5/2010 | Finn et al. | 415/9 |
| 8,021,102 | B2 * | 9/2011 | Xie et al. | 415/9 |
| 2007/0081887 | A1 * | 4/2007 | Xie et al. | 415/9 |
| 2008/0128073 | A1 | 6/2008 | Xie et al. | |
| 2009/0053043 | A1 * | 2/2009 | Moon | 415/144 |
| 2009/0151162 | A1 | 6/2009 | Xie et al. | |
| 2009/0155044 | A1 * | 6/2009 | Xie et al. | 415/9 |
| 2010/0077721 | A1 * | 4/2010 | Marshall | 60/39.091 |

FOREIGN PATENT DOCUMENTS

| | | |
|---|---|---|
| EP | 0626502 | 11/1994 |
| GB | 2219633 | 12/1989 |

OTHER PUBLICATIONS

EP Search Report for European Application No. 10251511.1-1607/2290197 completed Jan. 8, 2014.

* cited by examiner

*Primary Examiner* — Nathaniel Wiehe
*Assistant Examiner* — Woody A Lee, Jr.
(74) *Attorney, Agent, or Firm* — Carlson, Gaskey & Olds, P.C.

(57) ABSTRACT

A gas turbine engine fan section includes first and second composite layers providing a generally cylindrical case. Axially spaced apart rings are arranged between the first and second composite layers and form reinforcing ribs that provide a fan containment area axially between the rings. A belt is arranged over and spans the fan containment area between the reinforcing ribs. A fan blade has a tip in proximity to the first composite layer without any intervening structural support between the tip and the first composite layer, which provides a fan blade rub resistant surface. A method of manufacturing a fan containment case includes wrapping at least one first composite layer around a mandrel. Axially spaced apart rings are arranged circumferentially about the first composite layer. At least one second composite layer is wrapped around the rings and first composite layer to provide reinforcing ribs at the rings.

7 Claims, 2 Drawing Sheets

COMPOSITE FAN CONTAINMENT CASE

BACKGROUND

This disclosure relates to a composite fan containment case for a gas turbine engine.

One type of gas turbine engine incorporates a fan section at an inlet to the engine. The fan section includes a fan with fan blades surrounded by a fan case, which is surrounded by a fan nacelle. During operation, the engine may ingest foreign objects, such as a bird, which may cause portions of one or more fan blades to fracture and separate from the fan. The fan case is designed to contain the separated fan blade portions and prevent the portions from exiting the fan nacelle or being ingested further downstream in the engine.

A typical fan containment case is constructed from a metallic inner liner that is in close proximity to the tips of the fan blades. The metallic inner liner may be surrounded by a KEVLAR belt, which stretches to contain separated fan blade portions that penetrate the metallic inner liner. In applications where the fan section is relatively large, fan containment cases that use metallic inner liners are relatively heavy.

SUMMARY

A gas turbine engine fan section is disclosed that includes first and second composite layers providing a generally cylindrical case. Axially spaced apart rings are arranged between the first and second composite layers and form reinforcing ribs that provide a fan containment area axially between the rings. A belt is arranged over and spans the fan containment area between the reinforcing ribs. A fan blade has a tip in proximity to the first composite layer without any intervening structural support between the tip and the first composite layer, which provides a fan blade rub resistant surface.

A method of manufacturing a fan containment case includes wrapping at least one first composite layer around a mandrel. Axially spaced apart rings are arranged circumferentially about the first composite layer. At least one second composite layer is wrapped around the rings and first composite layer to provide reinforcing ribs at the rings.

These and other features of the disclosure can be best understood from the following specification and drawings, the following of which is a brief description.

DETAILED DESCRIPTION

Figure 1:
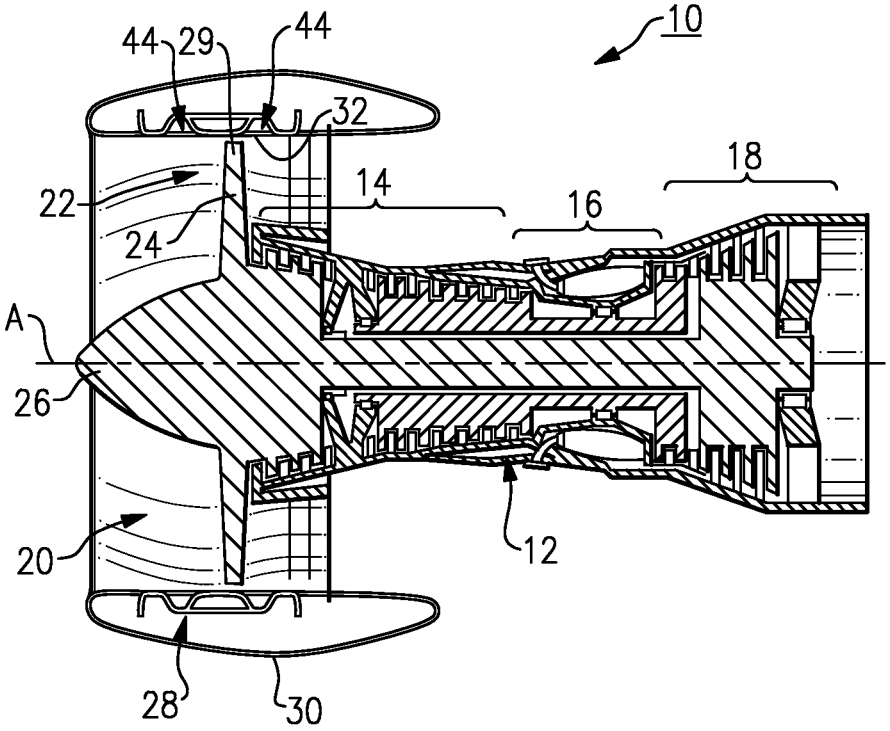
FIG. 1 is a cross-sectional view of an example gas turbine engine having a composite fan containment case.

A gas turbine engine 10 is schematically shown in FIG. 1. The engine 10 includes a core 12 having a compressor section 14, a combustion section 16 and a turbine section 18. A fan containment case 28 is supported on the core 12 by flow exit guide vanes. The fan containment case 28 houses a fan section 20 shown in front of the core 12 that includes multiple circumferentially arranged fan blades 24 and a nose cone 26. A fan nacelle 30 surrounds the fan containment case 28 and provides an inlet 22. The compressor, turbine and fan sections 14, 18, 24 are rotatable about an axis A. The fan containment case 28 is axially arranged relative to the fan 20 such that tips 29 of the fan blades 24 are arranged axially between reinforcing ribs 44 provided by the fan containment case 28.

Figure 2:
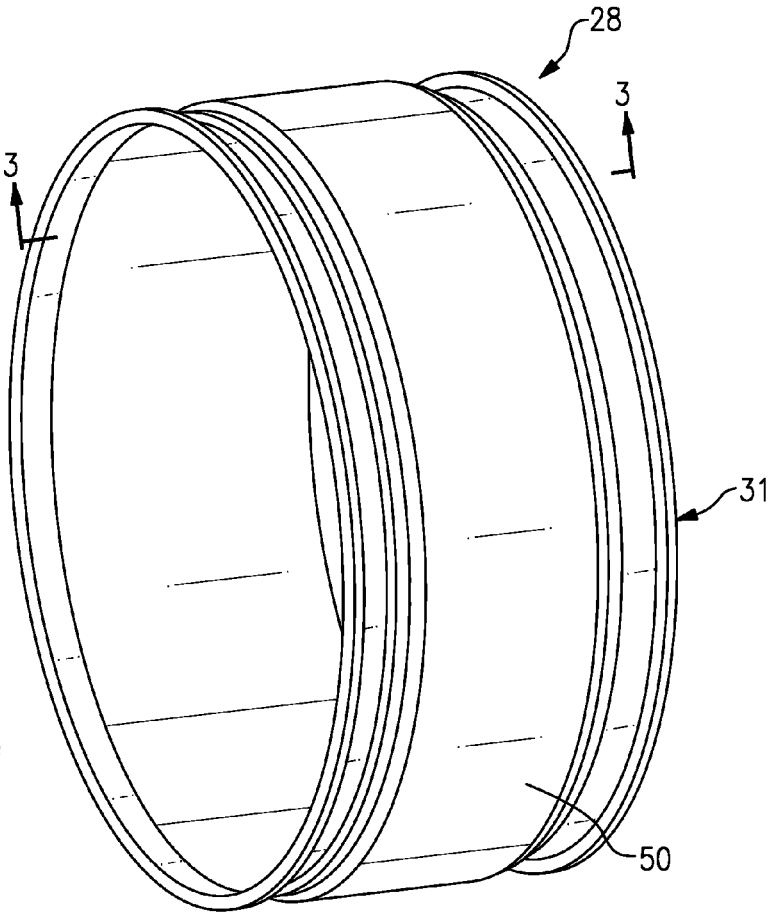
FIG. 2 is a perspective view of the example composite fan containment case.
Figure 3:
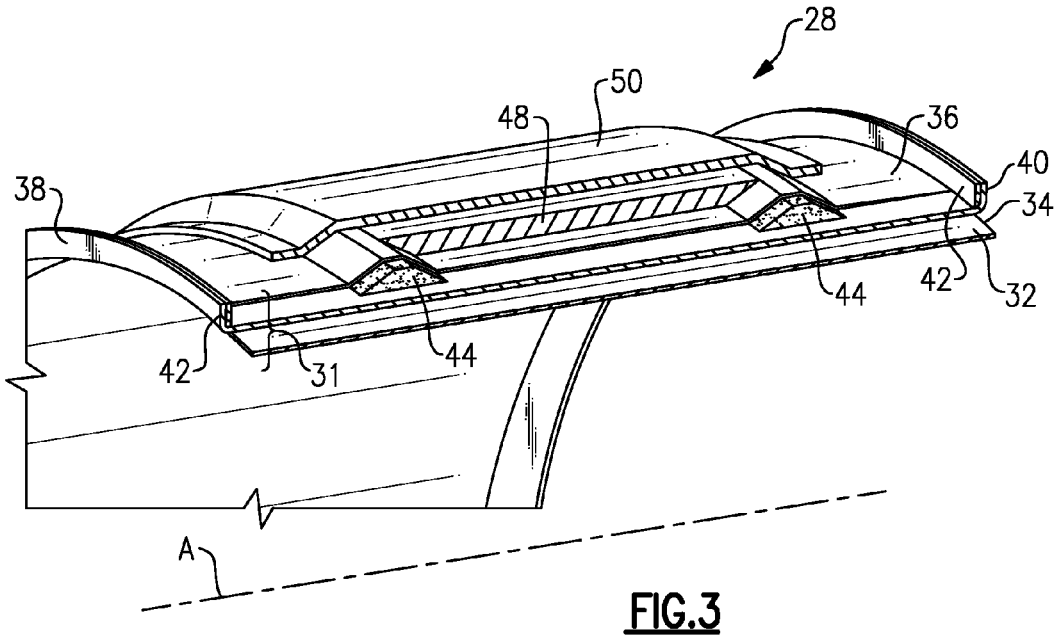
FIG. 3 is a perspective partial cross-sectional view of the composite fan containment case taken along line 3-3 in FIG. 2.

Referring to FIGS. 2 and 3, the fan containment case 28 includes a body 31 that is provided by multiple composite layers, which in the illustrated embodiment are constructed from carbon fibers and epoxy. In the example, the body 31 is provided by inner, main and outer layers 32, 34, 36, each of which may be provided by one or more plies. In this example, the material and construction of the plies within a given layer are common with one another, and the plies of one layer are different than the plies of another layer.

Figure 4:
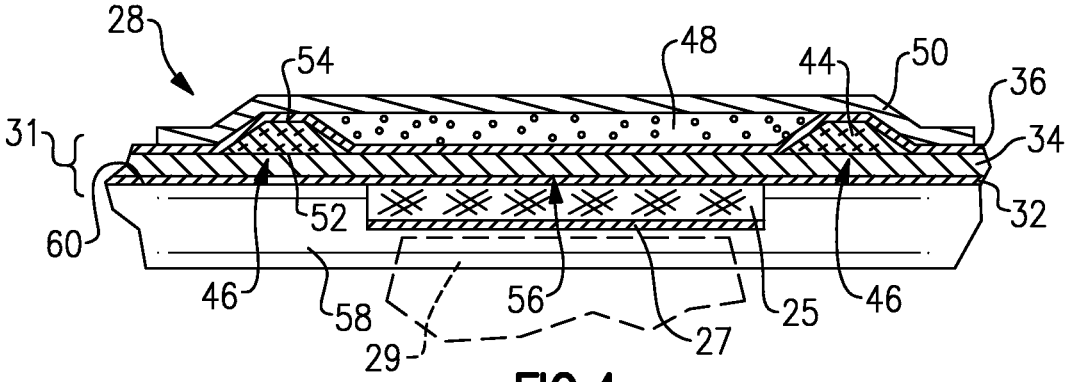
FIG. 4 is an enlarged cross-sectional view of the composite fan containment case shown in FIG. 3 arranged on a mandrel used in forming the fan containment case.

The inner layer 32 provides overall case ovalization support and blade rub resistance at a blade rub resistant surface in proximity to the tips 29 providing "soft wall" containment of the fan blades 24. In the example, there is no intermediate structural support between the tips 29 and the inner layer 32. The typical honeycomb structure 25 and rub strips 27 used to seal against the tips 29, however, is provided on the inner surface of the inner layer 32, as shown in FIG. 4. The honeycomb structure 25 and rub strips 27 are considered non-structural members. By way of contrast, some known fan cases use additional metallic inner liners instead of the inner layer 32 that provide structural support for radially outboard composite structures. The inner layer 32 utilizes a uniweave hoop construction, for example, with a thickness of approximately 0.0625 inch (1.5875 mm) thick, for example.

The main layer 34 includes a quasi-fiber orientation utilizing a braid, contour weave or similar structure, for example. In one example, the main layer 34 is approximately 0.250 inch (6.35 mm) thick. The main layer 34 utilizes plies that are turned radially outward at ends of the body 31 to provide front and rear flanges 38, 40. A radius block or flange backer 42 is provided at each of the front and rear flanges 38, 40 to reinforce those flanges. In one example, the flange backer 42 is secured to the front and rear flanges 38, 40 by an adhesive. Holes (not shown) may be provided through the flange backer 42 and front and rear flanges 38, 40 to accommodate fasteners that are utilized to secure the fan containment case 28 to adjacent structures.

Reinforcing ribs 44 are formed in the body 31 to provide increased structural rigidity to the fan containment case 28. In one example, the reinforcing ribs 44 are provided by supporting rings 46 on the main layer 34. The rings 46, which are constructed from a foam, such as polyurethane, may consist of multiple segments arranged about the circumference of the main layer 34. The rings 46 include a base 52 adjoining the main layer 34 and extending toward an apex 54 adjoining the outer layer 36. The base 52 has an axial width that is larger than the apex 54. A containment area 56 is provided between the reinforcing ribs 44. The rings 46 are axially positioned such that the tips 29 of the fan blades 24 are arranged between the rings 46 when the fan containment case 28 is in the installed position illustrated in FIG. 1.

The outer layer 36 is arranged over the main layer 34 and the rings 46 thereby providing the reinforcing ribs 44. The outer layer 36 is arranged axially between the front and rear flanges 38, 40 and is provided primarily by axial plies, in one example, to aid in supporting secondary loading such as support to the nacelle inlet. The outer layer 36, with the reinforcing ribs 44, increases hoop stiffness forward and aft of the containment area subsequent to a fan blade impact. If desired, hoop plies may be provided as part of the outer layer 36 to further increase hoop stiffness in the area.

A filler 48 is provided over the outer layer 36 between the reinforcing ribs 44. In one example, the filler 48 is provided by a meta-aramid nylon material honeycomb structure, such as NOMEX. One example NOMEX honeycomb filler is available as Hexcel HRH-10-1/4-2.0.

A belt 50 is provided over the reinforcing ribs 44 and the filler 48. The belt 50 prevents portions of the fan blades 24 and other debris from exiting the fan containment case 28 radially in the event of a bird strike, for example. In one example, the belt 50 is provided by an aromatic polyamide fiber fabric, such as KEVLAR. In one example, the belt 50 is constructed from up to fifty layers or more of a contour woven braid. The outermost layers of the belt 50 is adhered to the adjacent layer utilizing a scrim supported adhesive or similar structure, for example. The filler 48 acts as a spacer and provides support to the belt 50 during and subsequent to the curing process of the fan containment case 28. The filler 48 captures the fan blade debris as it rebounds radially inward subsequent to impacting the belt 50.

FIG. 4 illustrates a portion of the fan containment case 28 laid up on an outer surface 60 of a mandrel 58 during a forming process. The fan containment case 28 is formed using a resin transfer molding, vacuum assisted resin transfer molding process or autoclave. The inner layer 32 is wrapped around the outer surface 60 utilizing a prepreg carbon or graphite and epoxy braid, contour weave or similar structure. The main layer 34 is wrapped around the inner layer 32. The rings 46 are provided on the main layer 34 about its circumference and axially positioned to define a containment area 56. The flange backer 42 is slid over the main layer 34 at either end, and the main layer 34 is turned over to provide the front and rear flanges 38, 40 with the flange backer 42 in abutment with the main layer 34. The outer layer 36 is arranged over or wrapped around the main layer 34 and the rings 46 such that the rings engage the inner and main layers 32, 34. The filler 48 is laid over the outer layer 36 between the reinforcing ribs 44. The belt 50 is laid over and wrapped around the reinforcing ribs 44 and the filler 48.

Although an example embodiment has been disclosed, a worker of ordinary skill in this art would recognize that certain modifications would come within the scope of the claims. For that reason, the following claims should be studied to determine their true scope and content.

What is claimed is:

1. A gas turbine engine fan section comprising:

a body including main and outer composite layers providing a generally cylindrical case; axially spaced apart rings arranged between the main and outer composite layers forming forward and aft reinforcing ribs and providing a fan containment area axially there between;

an inner composite layer providing a fan blade rub resistant surface, wherein the main composite layer is adhered to the inner composite layer, the rings adjoining the main composite layer;

a honeycomb structure provided axially between the reinforcing ribs;

a belt arranged over and spanning the fan containment area between the forward and aft reinforcing ribs, the belt extending axially forward of the forward reinforcing rib to secure the belt to the body, and the belt extending axially rearward of the aft reinforcing rib to secure the belt to the body; and a fan blade having a tip in proximity to the inner composite layer without any intervening structural support between the tip and the inner composite layer.

2. The gas turbine engine fan section according to claim 1, wherein the main layer includes multiple plies, the inner, main, and outer composite layers include carbon fibers and epoxy.

3. The gas turbine engine fan section according to claim 1, wherein the rings include a polyurethane foam material.

4. The gas turbine engine fan section according to claim 1, comprising a filler arranged around the outer composite layer axially between the rings, the filler including a meta-aramid nylon material supported by the filler.

5. The gas turbine engine fan section according to claim 1, wherein the belt includes multiple layers of an aromatic polyamide fiber fabric, and wherein the belt is radially outward of the outer composite layer.

6. The gas turbine engine fan section according to claim 4, wherein the honeycomb structure and a rub strip are arranged radially between the tip and the inner composite layer, the honeycomb structure and the rub strip being non-structural members.

7. The gas turbine engine fan section according to claim 1, wherein the outer layer includes multiple plies, the plies of the outer layer being of a common construction and material, the main layer includes plies, the plies of the main layer being of a common construction and material, the inner layer including plies, the plies of the inner layer being of a common construction and material, and the layers being different than one another.

* * * * *